United States Patent [19]

Pugnale et al.

[11] Patent Number: 4,676,093

[45] Date of Patent: Jun. 30, 1987

[54] DOUBLE-WALL UNDERGROUND TANK

[75] Inventors: Peter J. Pugnale, The Woodlands, Tex.; Andrew A. Mance, Toledo, Ohio

[73] Assignee: Owens-Corning Fiberglas Corporation, Toledo, Ohio

[21] Appl. No.: 737,857

[22] Filed: May 28, 1985

[51] Int. Cl.[4] ..... G01M 3/32

[52] U.S. Cl. ..... 73/49.2; 220/426

[58] Field of Search ..... 73/49.2, 49.3; 220/466, 220/425, 426, 445, 469

[56] References Cited

U.S. PATENT DOCUMENTS

| | | | |
|---|---|---|---|
| 1,675,258 | 6/1928 | Dawsey | 220/425 X |
| 1,863,736 | 6/1932 | Willauer | 220/426 X |
| 2,503,339 | 4/1950 | Jandus | 220/466 X |
| 2,927,437 | 3/1960 | Rae | 220/426 X |
| 3,941,272 | 3/1976 | McLaughlin | 220/445 X |
| 4,537,328 | 8/1985 | Keesee et al. | 220/445 |

FOREIGN PATENT DOCUMENTS

| | | | |
|---|---|---|---|
| 1175502 | 8/1964 | Fed. Rep. of Germany | 73/49.2 |
| 1200619 | 9/1965 | Fed. Rep. of Germany | 73/49.2 |

*Primary Examiner*—Stewart J. Levy
*Assistant Examiner*—Joseph W. Roskos
*Attorney, Agent, or Firm*—Ronald C. Hudgens; Patrick P. Pacella; Paul J. Rose

[57] ABSTRACT

A double-wall tank having inner and outer walls bonded to connecting hollow annular ribs. A passageway through the ribs enable leak-detecting liquid to fill the spaces between ribs, within ribs, and between end caps.

5 Claims, 6 Drawing Figures

DOUBLE-WALL UNDERGROUND TANK

TECHNICAL FIELD

This invention relates generally to underground storage tanks, and more particularly to a double-wall underground storage tank having leak-detecting liquid between walls.

BACKGROUND ART

U.S. application, Ser. No. 572,034, filed Jan. 14, 1984 now abandoned, and assigned to the assignee of the instant application, discloses a double-wall underground tank wherein each of the annular ribs bonded to and connecting the inner and outer walls is formed of resin-impregnated glass filament windings wound to provide a rib of solid cross section.

DISCLOSURE OF INVENTION

In accordance with the invention, spaced hollow annular ribs are provided on and bonded to the exterior of the inner wall, a base sheet material is wound over the ribs to straddle the spaces therebetween, and the outer wall is formed over the ribs and base material, becoming bonded to the ribs. Leak-detecting liquid fills the spaces between ribs and the space within each rib.

BRIEF DESCRIPTION OF DRAWINGS

The invention is more fully described hereinafter, with reference to the accompanying drawings wherein.

BEST MODE OF CARRYING OUT THE INVENTION

Figure 1:
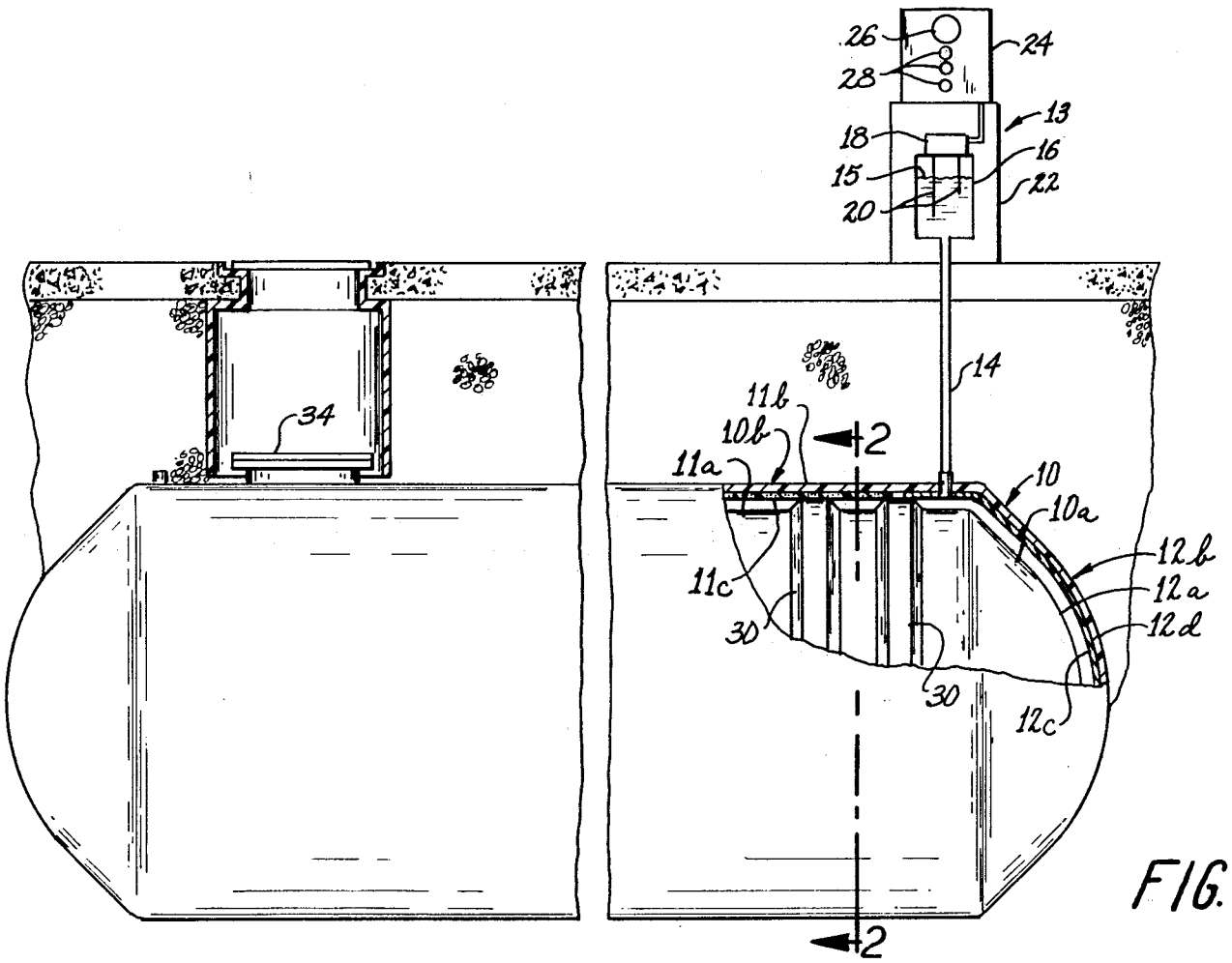
FIG. 1 is an elevational view, partly in section, of a double-wall underground tank constructed in accordance with the invention.
Figure 3:
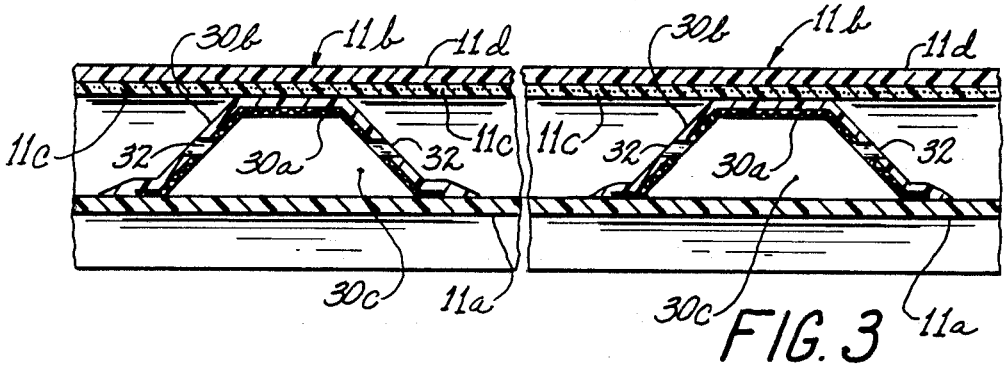
FIG. 3 is a fragmentary enlarged longitudinal sectional view taken generally along the line 3—3 of FIG. 2.
Figure 2:
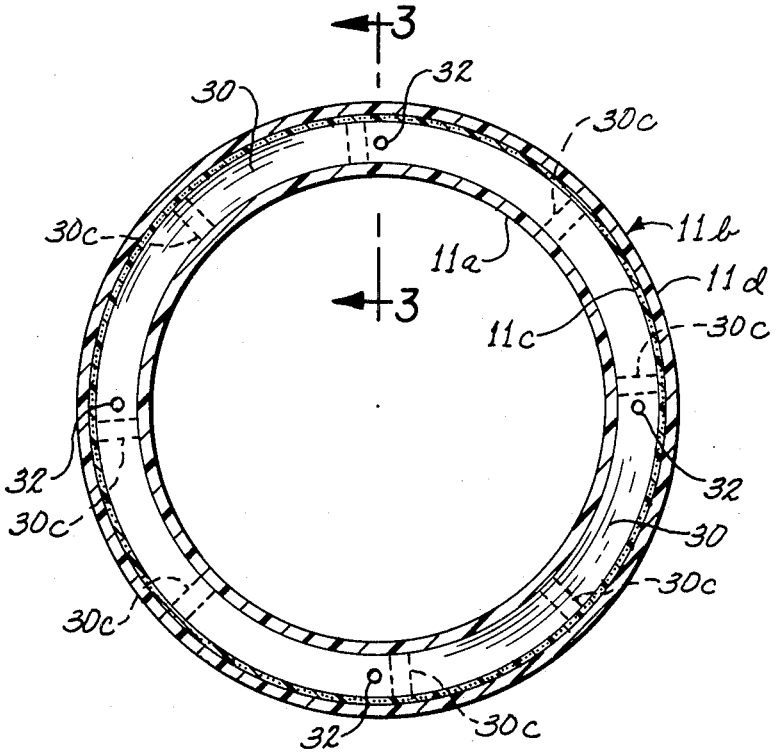
FIG. 2 is a cross-sectional view taken generally along the line 2—2 of FIG. 1.
Figure 4:
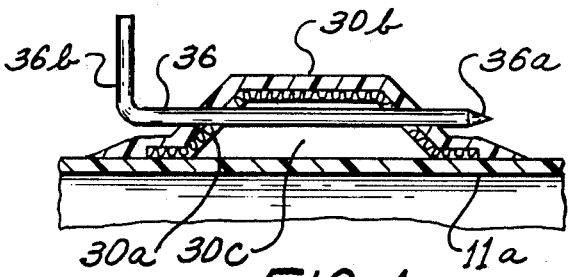
FIG. 4 is a fragmentary longitudinal sectional view similar to a portion of FIG. 3 but illustrating an earlier step in the manufacture of the tank before formation of the outer wall.

With reference to the drawings and in accordance with the invention, FIG. 1 shows a double-wall tank 10 installed underground and connected to above-ground leak detecting means 13 by a conduit 14. Essentially, the tank 10 comprises an inner tank 10*a* and an outer tank 10*b* surrounding the inner tank 10*a* with space therebetween, the space being filled with a leak detecting liquid 15 which also fills the pipe 14 and partially fills a container or reservoir 16, the pipe 14 being in communication with the space between the inner and outer tanks and with the reservoir. The leak detector 13 also includes an electrical control box 18 mounted above the reservoir 16 and having a pair of sensing probes 20 normally extending below the surface of the leak detecting liquid 15. The reservoir 16 and control box 18 are mounted in a housing 22. A monitoring board 24 is shown mounted on the housing 22, but could be remotely located inside a building. A bell or buzzer 26 and a plurality of lights 28 are mounted on the board 24 and electrically connected to the control box 18. Regardless of whether the inner tank 10*a* is full or empty and regardless of whether the tank 10 is installed in dry ground or below the water table, if a leak develops in either the inner tank 10*a* or the outer tank 10*b*, the level of the leak detecting liquid 15 in the container 16 will decrease. When the level drops below the sensing probes 20, the bell or buzzer 26 will emit an audible signalr and the lights 28 will give a visual indication that a leak has developed.

The double-wall tank 10 is made in two substantially identical halves each including an inner cylindrical wall 11*a*, an inner end cap 12*a*, an outer cylindrical wall 11*b*, an outer end cap 12*b*, and a plurality of axially spaced, annular, generally hollow ribs 30 between and bonded to the walls 11*a* and 11*b*. The outer end cap 12*b* includes a preform 12*c* and a lay-up 12*d* over the preform.

Additional details are shown in FIGS. 2–6. The outer wall 11*b* includes a base sheet 11*c* covered by a lay-up 11*d*. The ribs 30 include a preform 30*a* covered by a lay-up 30*b*. Each side of a rib 30 has four holes 32 extending therethrough respectively at the top, bottom, and opposite sides of the tank 10. A manway 34 is provided in one of the tank halves.

The inner cylindrical wall 11*a* and the inner end cap 12*a* of a tank half are formed first. Preferably the wall 11*a* is formed on a collapsible mandrel such as disclosed in U.S. Pat. No. 4,233,020, and the end cap 12*a* is preferably formed integrally with the wall 11*a* on an end cap mold mounted on the mandrel in a manner similar to that disclosed in U.S. Pat. No. 4,233,020, but having a shape such as disclosed in U.S. Pat. No. 4,071,161, wherein a spherical central portion merges with a frusto-conical peripheral portion. The procedure for forming the wall ll*a* may be somewhat as disclosed in U.S. Pat. No. 3,700,512. A surface mat and a relatively thin layer of hardenable liquid resin and chopped glass strand are applied to the rotating mandrel surface, followed by a relatively thick layer of hardenable liquid resin, chopped glass strand, and sand, and an overlapping of thin strips of filament windings axially spaced at intervals. The filament windings retain the rest of the material on the mandrel until the resin begins to set. While the wall 11*a* is being formed, an operator may spray-up the end cap 12*a* after applying a surface mat and hardenable liquid resin to the mold, using a spray gun spraying hardenable liquid resin, chopped glass strand, and sand.

The axially spaced annular ribs 30 are then applied to the wall 11*a*. For each rib 30, a cardboard form 30*a* similar to that shown in U.S. Pat. No. 3,412,891 is wrapped around the wall 11*a*. The form 30*a* is in the cross-sectional shape of a top and two sides of a trapezoid, the sides extending generally at 45° angles and being slotted to allow bending into an overall circular shape around the wall 11*a*. The trapezoidal shape is retained by correspondingly shaped foam blocks 30*c* spaced at intervals, the cardboard being stapled to the foam blocks. The form may be fed between the wall 11*a* and filament windings which hold it in place initially. A glass fiber reinforcement mat such as glass cloth, woven roving, or axial tape is then placed over the form 30*a* and resin-impregnated glass filament windings are wound thereover to form the lay-up 30*b*. The filament windings may be applied circumferentially, with no helix angle, as in U.S. Pat. No. 3,818,950, but are preferably cross-wound as in U.S. Pat. No. 3,661,294. Preferably the reinforcing mat is axial tape, a knitted undirectional mat of glass strands applied with the strands extending axially of the wall 11*a* and crosswise of the rib form 30*a*. Before the lay-up 30*b* is cured, holes 32 are punched therein with punching tools 36 (FIG. 4) left in place during the curing and thereafter removed. The punching tools 36 may each conveniently be a rod pointed at one end 36*a* long enough to extend through both sides of a rib 30, and bent 90° at the other end to provide a handle 36*b*. The holes 32 are formed 90° apart circumferentially of a rib and located adjacent the top, bottom, and opposite sides of the tank 10.

Figure 5:
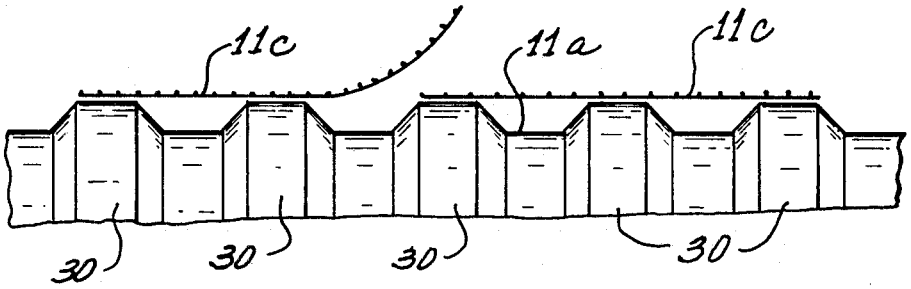
FIG. 5 is fragmentary longitudinal view illustrating another step in the manufacture of the tank.

Base sheets 11*c* are then placed over the ribs 30 as shown schematically in FIG. 5. Any suitable material may be used for the base sheets so long as the lay-up 11*d* is not prevented from bonding to the ribs 30. Therefore, if the base sheet is not porous, a separate sheet must be used to straddle the space between each pair of adjacent ribs and extend less than to the center of each of the two ribs, leaving a bonding area for the lay-up 11*d* open at the center of each rib. Preferably a porous scrim 11*c* is used, wide enough to cover three ribs 30 and initially held in place with a few filament windings at least at the two outer ribs of the three. The mesh size of the scrim 11*c* is large enough for resin to pass therethrough at the ribs 30 but small enough so resin applied to the scrim between ribs will bridge the holes to form a solid sheet. Therefore, resin is applied to the scrim 11*c* and allowed to cure enough to make the scrim stiff between ribs. Preferably a small amount of chopped glass strand is applied to the resin impregnated scrim. Adjacent scrim strips 11*c*, each wide enough to cover three ribs 30, are placed so that edge portions of two scrim strips 11*c* overlap at a commonly covered rib 30, as indicated in FIG. 5. The scrim is preferably glass fiber scrim.

After the resin on the scrim has cured enough to stiffen the scrim, the lay-up 11*d* of the outer wall is applied and consists of resin, chopped glass strand, and sand. At the free end of the mandrel, the preform 12*c* is telescoped over the corresponding end rib 30 and the lay-up 12*d*, of resin, chopped glass strand, and sand, is sprayed up thereover. After curing, the tank half is removed from the mandrel.

Figure 6:
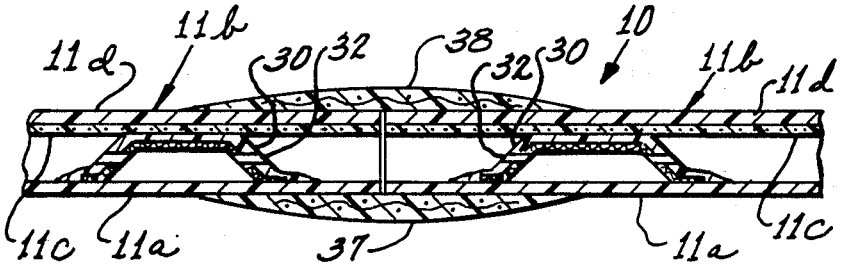
FIG. 6 is a fragmentary longitudinal sectional view of the tank at the juncture of two halves.

Two such tank halves are formed, each having a sacrificial rib 30 adjacent its open end. The tank halves are each sawed through to remove the sacrificial rib 30 and thereby provide an overhang of the outer wall 11*b* flush with the end of the inner wall 11*a*. One of the tank halves is provided with the manway 34, and the two tank halves are then secured together by an internal lay-up 37 and an external lay-up 38 (FIG. 6). The foam blocks 30*c* are not in liquid-tight relationship with the forms 30*a*, and the leak-detecting liquid 15 fills the hollow ribs 30, the spaces between ribs 30 and between the walls 11*a* and 11*b*, and the spaces between the end caps 12*a* and 12*b*.

Various modifications may be made in the structure shown and described without departing from the spirit and scope of the invention.

We claim:

1. A double-wall tank particularly adapted for use underground and comprising radially spaced inner and outer cylindrical walls bonded to hollow ribs disposed therebetween, each of the hollow ribs extending lengthwise annularly around the inside of the outer cylindrical wall and around the outside of the inner cylindrical wall and the hollow ribs being spaced from each other axially of the cylindrical walls, and spaces in the hollow ribs being in communication with spaces between the ribs and between the cylindrical walls.

2. A double-wall tank particularly adapted for underground use and comprising a generally cylindrical inner wall, a generally cylindrical outer wall surrounding the inner wall and being spaced radially therefrom, a pair of opposed inner end caps respectively closing opposite ends of the cylindrical inner wall, a pair of opposed outer end caps respectively closing opposite ends of the cylindrical outer wall and being spaced respectively from the inner end caps, and a plurality of hollow ribs disposed between the inner and outer walls and bonded respectively thereto, each of the hollow ribs extending lengthwise annularly around the inside of the outer cylindrical wall and around the outside of the inner cylindrical wall and the hollow ribs being spaced from each other axially of the cylindrical walls, and spaces in the hollow ribs being in communication with spaces between the ribs and between the inner and outer walls.

3. A tank as claimed in claim 2 wherein the inner and outer cylindrical walls, the inner and outer end caps, and the hollow annular ribs are formed of glass fiber reinforced plastic.

4. A tank as claimed in claim 2 including leak detecting liquid in the spaces between end caps and in the spaces between the inner and outer walls both between the ribs and within the hollow ribs, said leak detecting liquid forming part of a leak detecting system.

5. A leak detecting system for a double-wall tank as claimed in claim 2 comprising a reservoir above the tank, a conduit connecting the inside of the reservoir to the space between the inner and outer walls of the tank, leak detecting liquid filling the space in the hollow ribs, the space between ribs, the space between the end caps, the conduit, and at least partially filling the reservoir, means for sensing a drop in the level of the liquid in the reservoir, and means for providing a signal in response to a sensed drop in said level.

* * * * *